US012448872B1

(12) United States Patent
Zavala Caraballo et al.

(10) Patent No.: US 12,448,872 B1
(45) Date of Patent: Oct. 21, 2025

(54) LINER HANGER WITH MECHANICALLY LOCKED HYDRAULIC ACTUATOR

(71) Applicant: WEATHERFORD TECHNOLOGY HOLDINGS, LLC, Houston, TX (US)

(72) Inventors: Jose V. Zavala Caraballo, Katy, TX (US); David Myles, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/640,243

(22) Filed: Apr. 19, 2024

Related U.S. Application Data

(60) Provisional application No. 63/635,739, filed on Apr. 18, 2024.

(51) Int. Cl.
*E21B 43/10* (2006.01)
*E21B 23/01* (2006.01)

(52) U.S. Cl.
CPC ..... *E21B 43/10* (2013.01); *E21B 23/01* (2013.01)

(58) Field of Classification Search
CPC ..... E21B 43/10; E21B 23/01; E21B 23/00; E21B 23/04; E21B 23/0411; E21B 23/042; E21B 33/04
See application file for complete search history.

(56) References Cited

U.S. PATENT DOCUMENTS

| | | | | |
|---|---|---|---|---|
| 2,315,931 | A * | 4/1943 | Burt | E21B 33/14 166/143 |
| 2,589,337 | A * | 3/1952 | Burns | E21B 43/10 166/216 |
| 8,453,729 | B2 | 6/2013 | Harris et al. | |
| 8,684,096 | B2 | 4/2014 | Harris et al. | |
| 9,376,877 | B2 | 6/2016 | Yue et al. | |
| 9,650,854 | B2 | 5/2017 | Devarajan et al. | |
| 9,874,070 | B2 | 1/2018 | Hanson et al. | |
| 10,100,612 | B2 | 10/2018 | Lisowski et al. | |
| 10,246,965 | B2 | 4/2019 | Turley et al. | |
| 11,180,970 | B2 | 11/2021 | Main et al. | |
| 2015/0260004 | A1 | 9/2015 | Pickle et al. | |

* cited by examiner

*Primary Examiner* — George S Gray
(74) *Attorney, Agent, or Firm* — Smith IP Services, P.C.

(57) ABSTRACT

A liner hanger can include slips configured to anchor the liner hanger in a well, a tubular mandrel, a tubular outer housing outwardly surrounding the mandrel, an engagement member that releasably secures the slips against longitudinal displacement relative to the mandrel, and another engagement member that releasably secures the outer housing against longitudinal displacement relative to the mandrel. A method of setting a liner hanger in a subterranean well can include: applying a differential pressure from an interior to an exterior of the liner hanger, thereby displacing a retainer sleeve relative to a mandrel of the liner hanger, and applying another differential pressure from the interior to the exterior of the liner hanger, thereby displacing an outer housing of the liner hanger relative to the mandrel. The outer housing is prevented from displacing relative to the mandrel until after the retainer sleeve is displaced relative to the mandrel.

18 Claims, 9 Drawing Sheets

LINER HANGER WITH MECHANICALLY LOCKED HYDRAULIC ACTUATOR

CROSS-REFERENCE TO RELATED APPLICATION

This application claims the benefit of the filing date of U.S. provisional application No. 63/635,739 filed on 18 Apr. 2024. The entire disclosure of the prior application is incorporated herein by this reference for all purposes.

BACKGROUND

This disclosure relates generally to equipment utilized and operations performed in conjunction with a subterranean well and, in examples described below, more particularly provides a liner hanger.

A liner is a protective lining used in a wellbore. A liner hanger is used to anchor the liner in a previously installed liner or casing.

Unfortunately, in some circumstances a liner hanger can be inadvertently set before it has been appropriately positioned in the previous liner or casing. Such an improperly set liner hanger can result in expensive and time-consuming operations to mitigate this problem.

It will, therefore, be appreciated that improvements are continually needed in the art of designing, constructing and operating liner hangers for use in subterranean wells. The present disclosure provides such improvements, which may be used in a variety of different types of well environments and well configurations.

DETAILED DESCRIPTION

Figure 1:
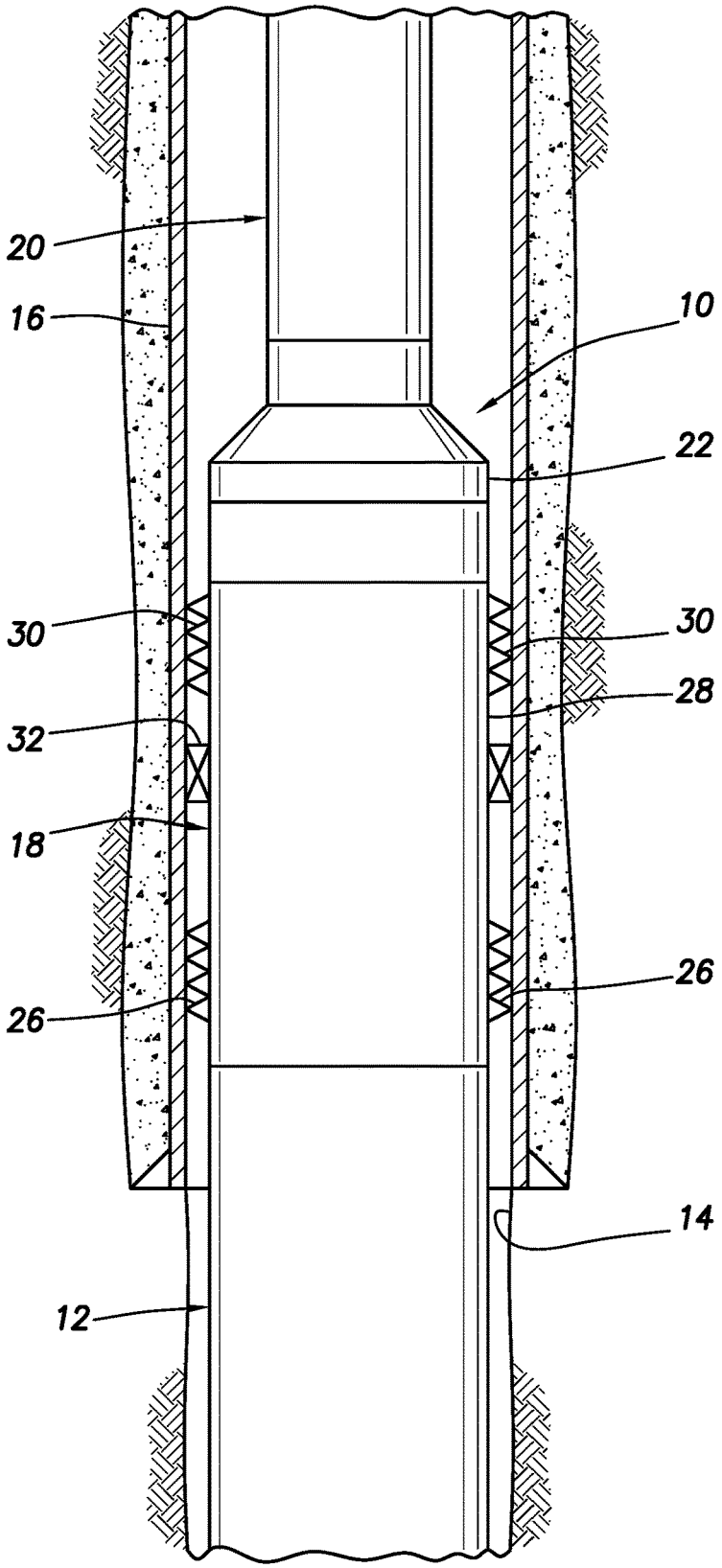
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIG. 1, a liner string 12 is installed in a wellbore 14 and is secured to a previously installed liner or casing 16 with a liner hanger 18. A work string 20 with a running tool 22 is used to convey the liner string 12 in the wellbore 14, and then to set the liner hanger 18 when it is appropriately positioned in the previous liner or casing 16.

In the FIG. 1 example, the liner hanger 18 is set by applying increased pressure in the work string 20 after deploying a ball, dart or other plug 24 (see FIG. 2B) into the work string. The applied pressure causes slips 26 to extend outward from the liner hanger 18 and grip an interior surface of the previous liner or casing 16. A packer section 28 of the liner hanger 18 includes additional slips 30 and an annular seal 32 that extend outwardly to grip the interior surface and seal against the interior surface, respectively, after the initial slips 26 are set.

It is important that the liner hanger 18 not be set until it is positioned at a desired location in the previous liner or casing 16. As described more fully below, the liner hanger 18 includes features that prevent it from being set until it is appropriately positioned in the previous liner or casing 16.

Figure 2A:
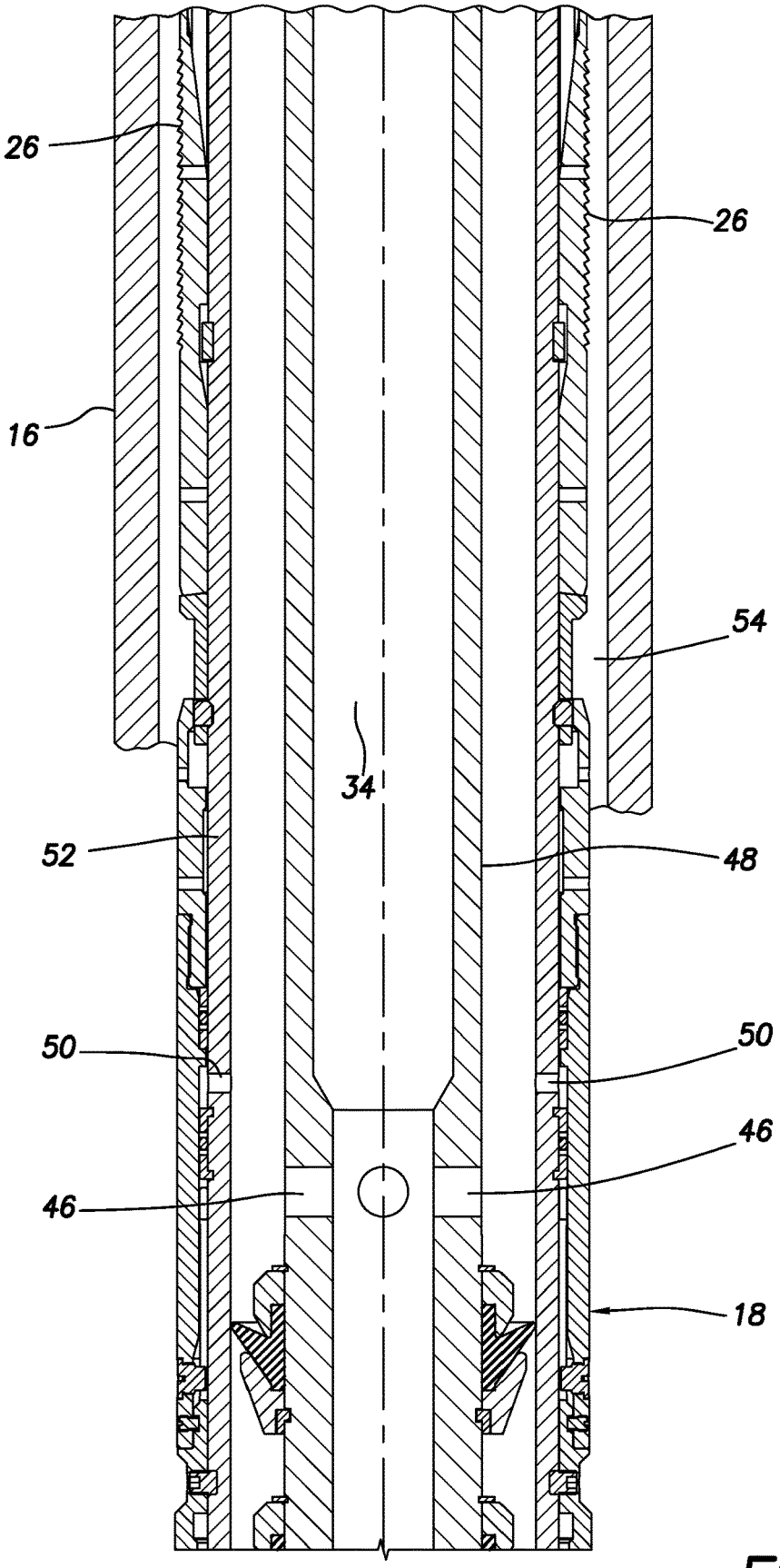
FIGS. 2A & B are representative cross-sectional views of an example of a liner hanger and a running tool as used in the well system and method.
Figure 2B:
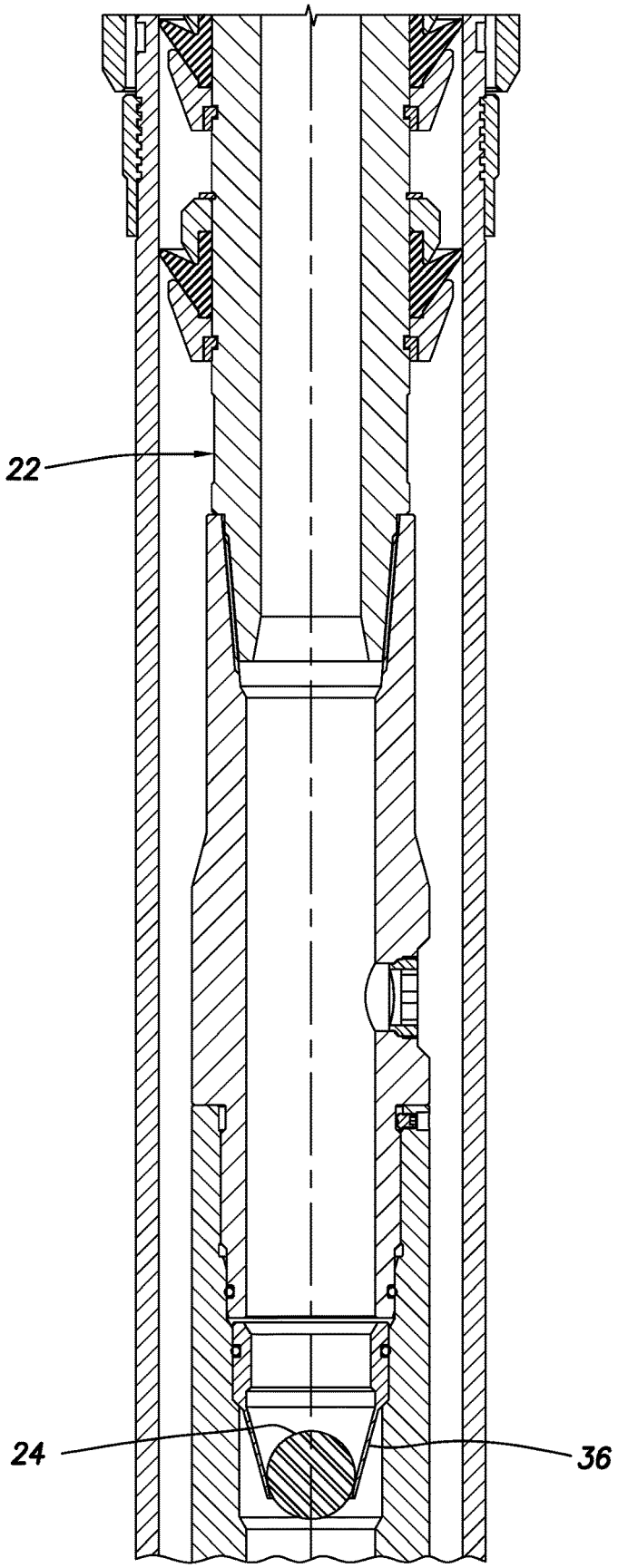

Referring additionally now to FIGS. 2A & B, more detailed cross-sectional views of a portion of examples of the liner hanger 18 and running tool 22 are representatively illustrated. The liner hanger 18 and running tool 22 may be used in the FIG. 1 system 10 and method, or they may be used in other systems and methods. For convenience, setting of the liner hanger 18 with the running tool 22 is described below as used with the FIG. 1 system 10 and method.

As depicted in FIGS. 2A & B, the liner hanger 18 has been positioned at a desired location in the previous liner or casing 16 for setting the liner hanger. The plug 24 has been deployed into a flow passage 34 extending through the running tool 22 and the work string 20 (see FIG. 1). As viewed in FIGS. 2A & B, the plug 24 has engaged an expandable seat 36 of the running tool 22.

Sufficient increased pressure applied to the flow passage 34 uphole of the plug 24 will cause the increased pressure to be applied to an interior of the liner hanger 18 via ports 46 formed in a tubular mandrel 48 of the running tool 22. The increased pressure enters at least one port 50 formed through an inner tubular mandrel 52 of the liner hanger 18.

The liner hanger 18 is set in response to the increased pressure applied via the port 50. More specifically, the liner hanger 18 is set in response to a predetermined differential pressure created between an interior of the liner hanger (communicated via the port 50) and an exterior of the liner hanger (such as, an annulus 54 formed radially between the liner hanger and the interior surface of the previous liner or casing 16).

Note that the FIGS. 2A & B running tool 22 is merely one example of a running tool that may be used to set the liner hanger 18. Other types of running tools (with or without an expandable seat) may be used in other examples. The scope of this disclosure is not limited to use of any particular type or configuration of running tool used to set the liner hanger 18.

Referring additionally now to FIGS. 3A-7, cross-sectional views of another example of the liner hanger 18 are representatively illustrated in a succession of stages of setting the liner hanger. The upper packer section 28 (see FIG. 1) and the running tool 22 (see FIGS. 1 and 2A & B) are not shown in FIGS. 3A-7 for clarity of illustration and description. Instead, only the setting of the initial set of slips 26 is described below, for an understanding of how inadvertent premature setting of the liner hanger 18 can be prevented using the principles of this disclosure.

Figure 3A:
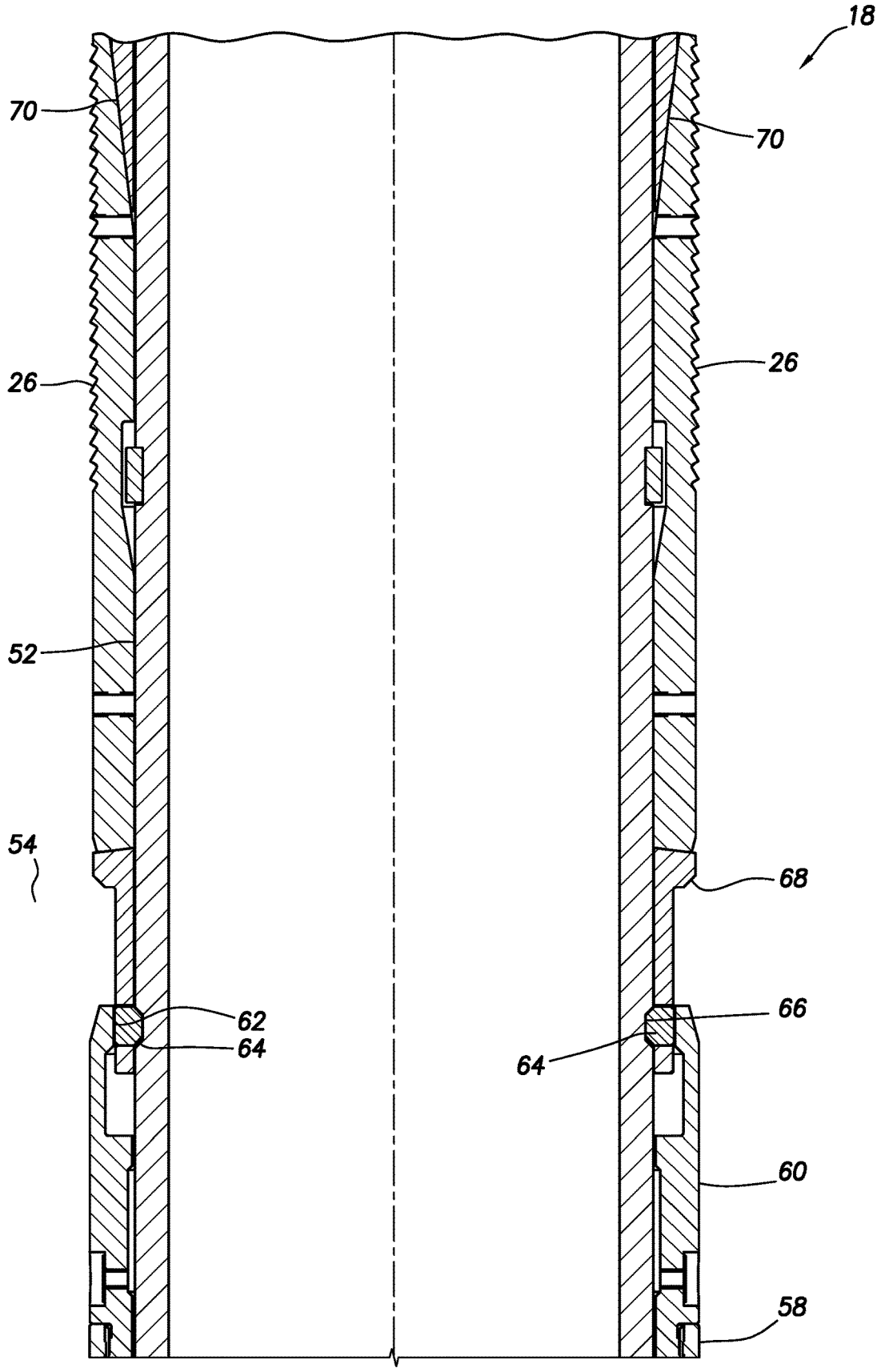
FIGS. 3A & B are representative partially cross-sectional views of another example of a liner hanger in a run-in configuration.

As depicted in FIGS. 3A & B, the liner hanger 18 is in a run-in configuration in which the liner hanger is conveyed into the previous liner or casing 16 (see FIGS. 1 and 2A &

B). The slips 26 are in radially retracted positions in which they will not grip the previous liner or casing 16 (or any other structure surrounding the liner hanger 18). A gauge ring 56 secured to the mandrel 52 maintains radial spacing between the slips 26 and the previous liner or casing 16 as the liner hanger 18 is conveyed into a well.

A tubular outer housing 58 outwardly surrounds the mandrel 52. An actuation sleeve 60 is secured at an upper end of the outer housing 58. A support surface 62 formed in the actuation sleeve 60 outwardly supports multiple engagement members 64 in engagement with an annular profile 66 formed on the mandrel 52. In this example, the engagement members 64 are in the form of dogs or lugs, but in other examples collets may be used.

The engagement members 64 extend through a slip connector 68 that is secured to the slips 26. While the engagement members 64 are radially inwardly maintained in engagement with the profile 66 by the actuation sleeve 60, the slips 26 cannot be displaced longitudinally relative to the mandrel 52. When the engagement members 64 are not maintained in engagement with the profile 66 by the actuation sleeve 60 (as described more fully below), the slips 26 can be set by displacing them upward relative to the mandrel 52, so that the slips are deflected radially outward by conical wedges 70 into gripping engagement with the previous liner or casing 16.

Annular seals 72, 74 seal between an inner surface of the outer housing 58 and an outer surface of the mandrel 52. An annular chamber 76 is formed longitudinally between the seals 72, 74 and radially between the outer housing 58 and the mandrel 52. The chamber 76 is in fluid communication with an interior of the mandrel 52 via the ports 50.

A retainer ring 78 prevents upward displacement of the seal 74 relative to the mandrel 52. A retainer sleeve 80 is positioned in an annulus 82 formed radially between the outer housing 58 and the mandrel 52. The chamber 76 is a portion of the annulus 82.

A support surface 84 formed on the retainer sleeve 80 radially outwardly supports engagement members 86 (only one of which is visible in FIG. 3B) in engagement with respective recesses 88 (only one of which is visible in FIG. 3B) formed in the outer housing 58. In this example, the engagement members 86 are in the form of dogs or lugs, but in other examples collets may be used.

The engagement members 86 extend through a sleeve 90 portion of the gauge ring 56. The gauge ring sleeve 90 is received in an annular space radially between the outer housing 58 and the retainer sleeve 80. The gauge ring 56 is secured against longitudinal displacement relative to the mandrel 52.

While the engagement members 86 are maintained in engagement with the recesses 88 by the retainer sleeve 80 support surface 84, the outer housing 58 is prevented from displacing longitudinally upward relative to the mandrel 52. In this manner, inadvertent premature setting of the liner hanger 18 is prevented. When the engagement members 86 are no longer supported in engagement with the recesses 88, increased pressure applied to the chamber 76 via the ports 50 can be used to displace the outer housing 58 upward to thereby set the slips 26 (as described more fully below).

Figure 3B:
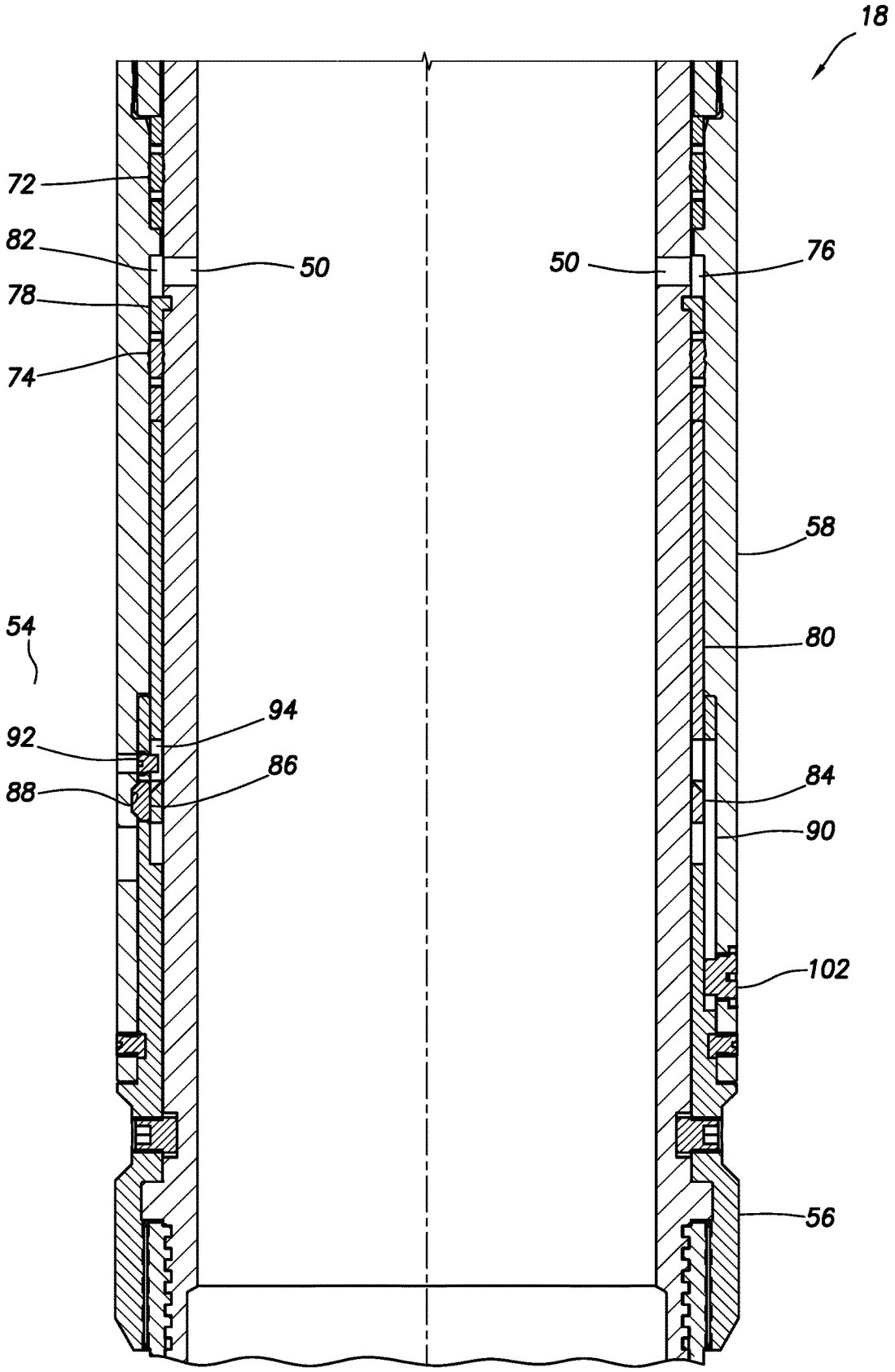

Shear members 92 (such as, shear pins, shear screws, etc., only one of which is visible in FIG. 3B) extend through the gauge ring sleeve 90 and into openings 94 formed through the retainer sleeve 80. The seal 74 acts as a piston to apply a downwardly biasing force against the retainer sleeve 80 in response to an increased pressure applied to the chamber 76. When a sufficient differential pressure has been applied from the chamber 76 to the annulus 54 (that is, from an interior to an exterior of the liner hanger 18), the shear members 92 will shear and allow the retainer sleeve 80 to displace downward relative to the mandrel 52.

Figure 4:
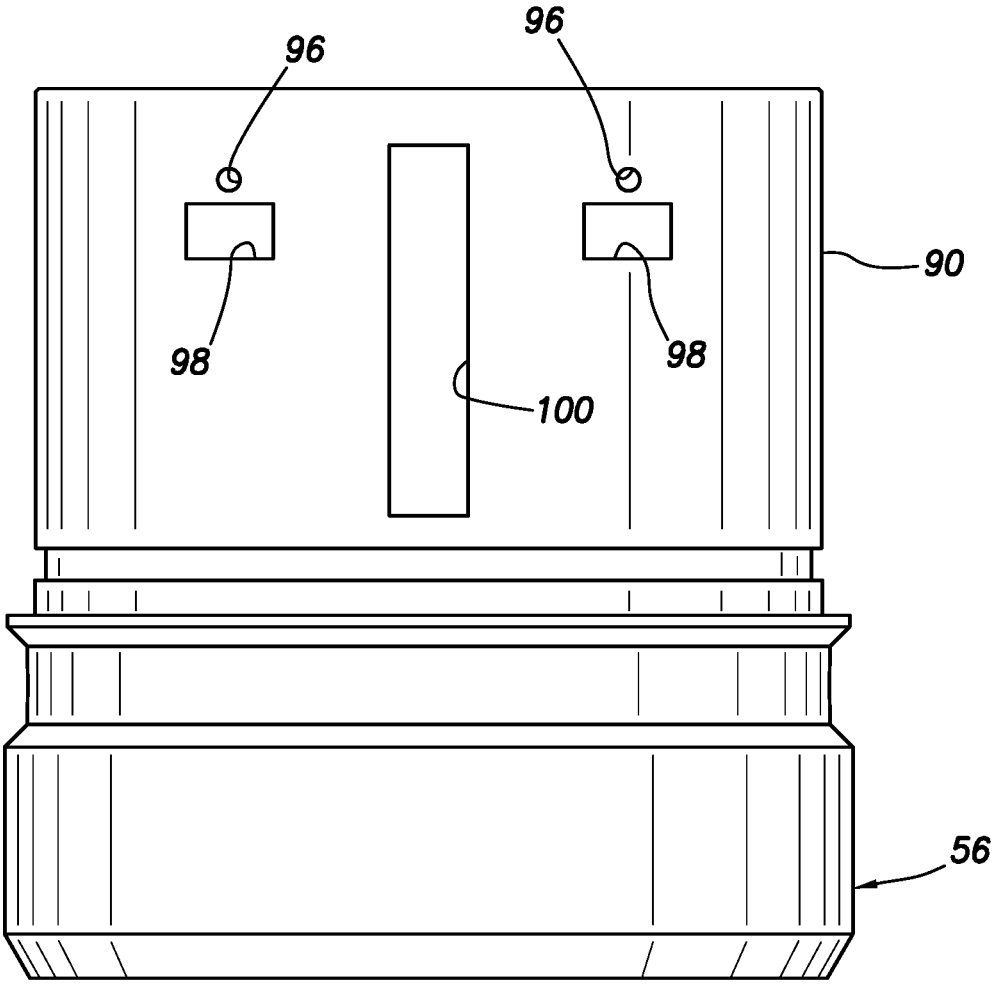
FIG. 4 is a representative side view of an example of a gauge ring of the FIGS. 3A & B liner hanger.

Referring additionally now to FIG. 4, a side view of an example of the gauge ring 56 is representatively illustrated. In this view, it may be seen that the gauge ring 56 has multiple circumferentially distributed sets of openings 96, 98 formed radially through the sleeve 90.

In this example, the openings 96 are internally threaded for securement of the shear members 92 therein (which are externally threaded). The openings 98 receive the engagement members 86 therein (see FIG. 3B).

A longitudinally extending slot 100 formed through the upper sleeve 90 receives a torque pin 102 (see FIG. 3B) therein. The torque pin 102 is secured to the outer housing 58. Thus, the outer housing 58 can displace longitudinally relative to the mandrel 52 (when the liner hanger 18 is set), but relative rotation between the outer housing and the mandrel is prevented by engagement of the torque pin 102 with the slot 100.

Figure 5:
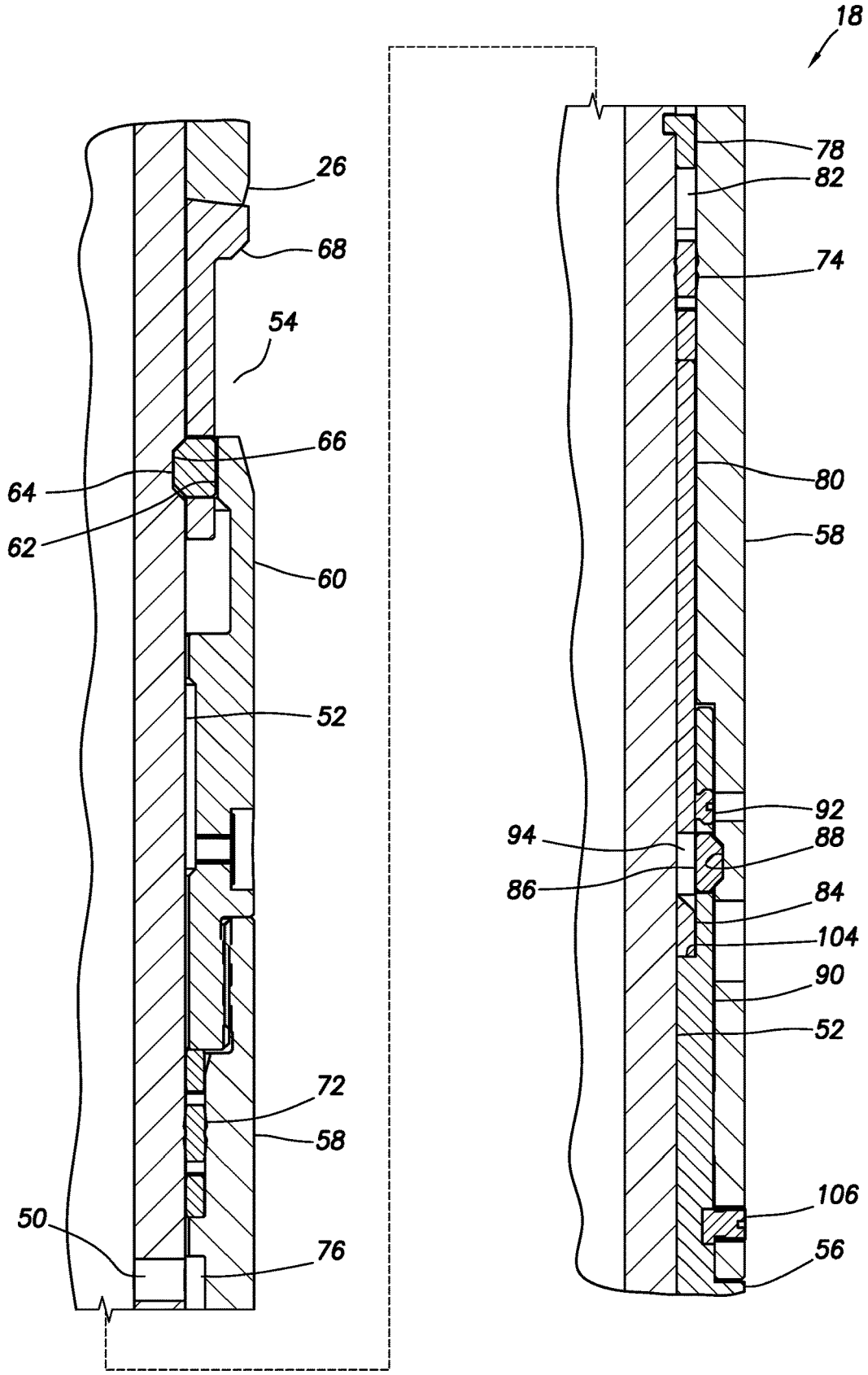
FIG. 5 is a representative cross-sectional view of the FIGS. 3A & B liner hanger in a partially set configuration.

Referring additionally now to FIG. 5, the liner hanger 18 is representatively illustrated in a partially set configuration. In this configuration, sufficient increased pressure has been applied to the chamber 76 via the ports 50 (for example, using the FIGS. 2A & B running tool 22) to cause the shear members 92 to shear.

The increased differential pressure across the seal 74 has caused the seal to displace downward relative to the mandrel 52, thereby also displacing the retainer sleeve 80 downward. The level of differential pressure required to shear the shear members 92 and allow the retainer sleeve 80 to be displaced downward can be adjusted by varying the number of shear members 92, or by varying a shear strength of the shear members.

Downward displacement of the retainer sleeve 80 is limited by an internal shoulder 104 formed in the gauge ring 56. In its downwardly displaced position, the openings 94 are aligned with the engagement members 86.

The support surface 84 on the retainer sleeve 80 no longer outwardly supports the engagement members 86 in engagement with the recesses 88. However, the engagement members 86 do not necessarily retract radially inward, until the outer housing 58 displaces upward relative to the mandrel 52, as described more fully below. Shear members 106 extending through the outer housing 58 and into the gauge ring 56 releasably secure the outer housing against upward displacement relative to the mandrel 52.

Figure 6:
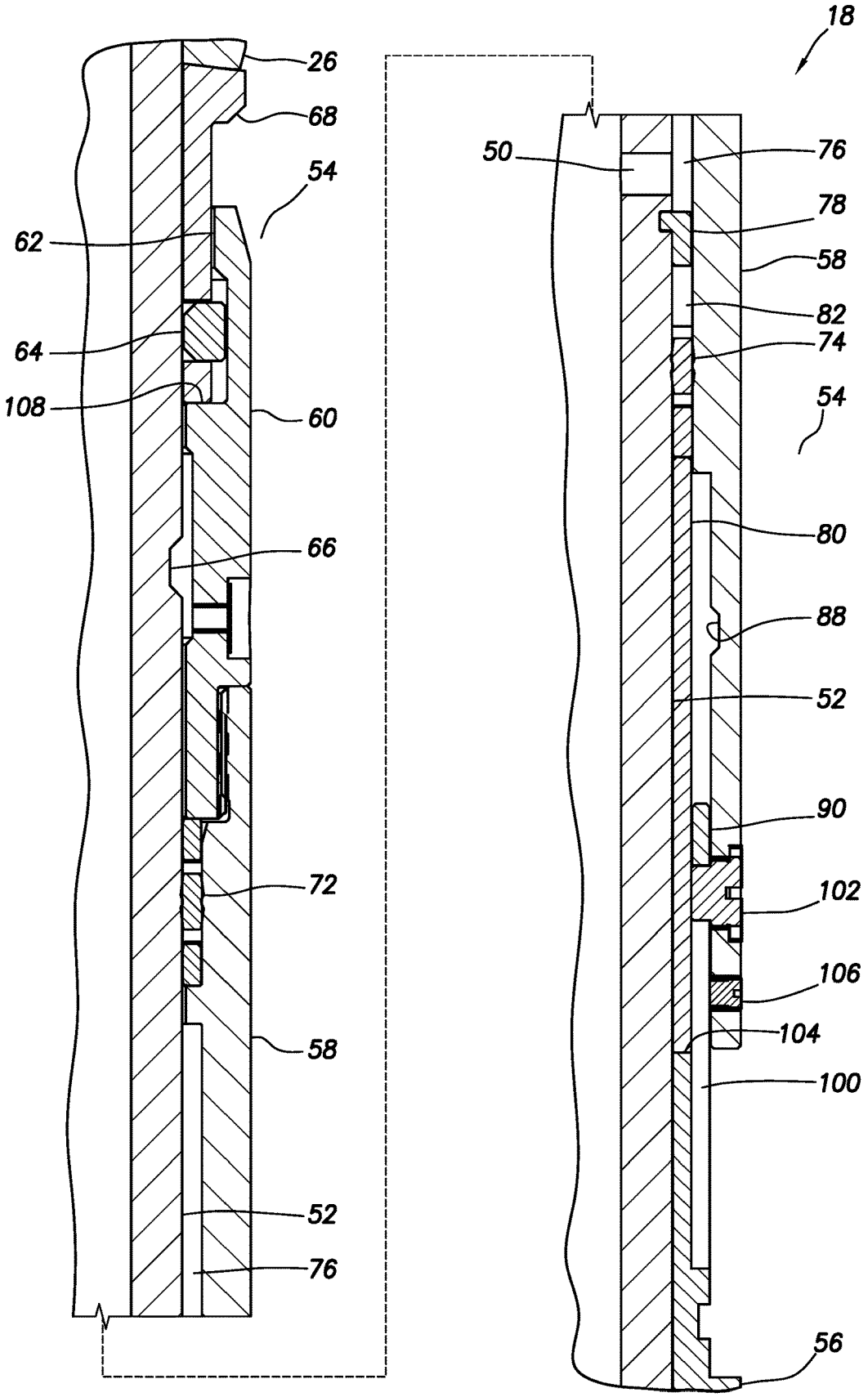
FIG. 6 is a representative cross-sectional view of the FIGS. 3A & B liner hanger in a set configuration.

Referring additionally now to FIG. 6, a cross-sectional view of the liner hanger 18 in a set configuration is representatively illustrated. The FIG. 6 view is rotated somewhat relative to the FIG. 5 view, so that the engagement of the torque pin 102 in the slot 100 is visible in FIG. 6.

In the FIG. 6 set configuration, sufficient increased pressure has been applied to the chamber 76 to cause the shear members 106 to shear and thereby allow the outer housing 58 to displace upward relative to the mandrel 52. The increased differential pressure applied across the seal 72 causes an upwardly directed biasing force to be applied to the outer housing 58 and the actuation sleeve 60, with this biasing force being sufficient to shear the shear members 106.

The level of differential pressure required to shear the shear members 106 and allow the outer housing 58 to be displaced upward can be adjusted by varying the number of shear members 106, or by varying a shear strength of the shear members. The differential pressure required to shear the shear members 106 is preferably greater than the differential pressure required to shear the shear members 92, but in some examples the differential pressure required to shear the shear members 106 could be equal to or less than the differential pressure required to shear the shear members 92.

When the outer housing 58 displaces upward, the actuation sleeve 60 also displaces upward, so that the support surface 62 no longer outwardly supports the engagement members 64. Thus, the engagement members 64 are allowed to displace radially outward and out of engagement with the profile 66. Inclined surfaces on the engagement members 64 and the profile 66 cause the engagement members to displace radially outward as the actuation sleeve 60 displaces upward due to the differential pressure across the seal 72.

An abutment surface 108 formed in the actuation sleeve 60 eventually contacts a lower end of the slip connector 68. The slip connector 68 and the slips 26 are thereby displaced upward relative to the mandrel 52 by the biasing force due to the differential pressure across the seal 72. The slips 26 are deflected outward by the wedges 70 (see FIGS. 3A & B) into gripping engagement with the interior surface of the previous liner or casing 16 as described above.

Figure 7:
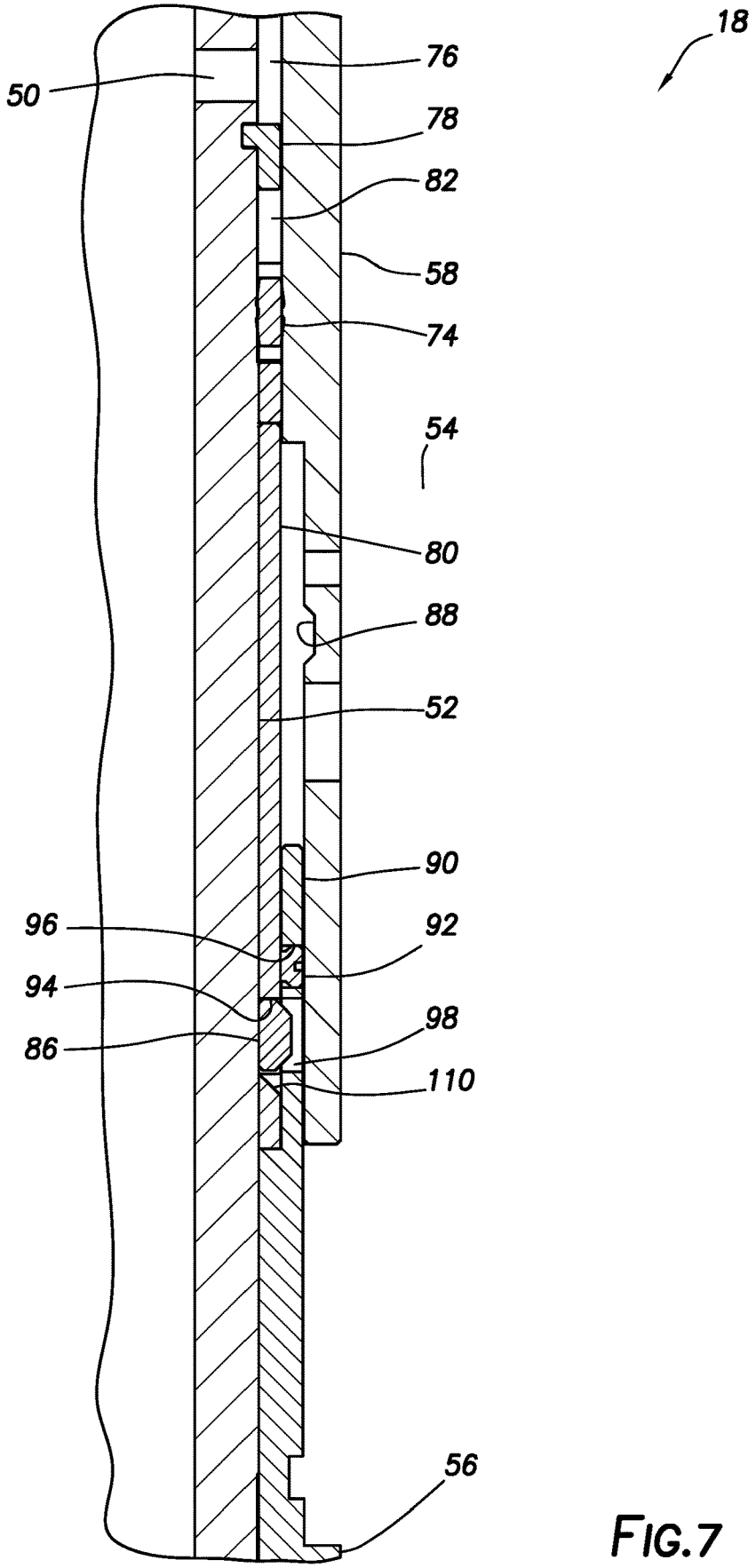
FIG. 7 is another representative cross-sectional view of the FIGS. 3A & B liner hanger in a set configuration, FIG. 7 being rotationally offset from the FIG. 6 view.

Referring additionally now to FIG. 7, another cross-sectional view of a lower portion of the liner hanger 18 is representatively illustrated in the set configuration. In this view, the liner hanger 18 is rotated somewhat relative to the FIG. 6 view, so that one of the engagement members 86 is visible in the FIG. 7 view.

As the outer housing 58 is displaced upward relative to the mandrel 52, inclined surfaces on the engagement members 86 and the recesses 88 cause the engagement members to be displaced radially inward and into the openings 94 in the retainer sleeve 80. Thus, the engagement members 86 no longer prevent upward displacement of the outer housing 58 relative to the mandrel 52. The outer housing 58 can displace upward due to the differential pressure across the seal 72 to the set configuration as described above.

Note that the FIGS. 3A-7 liner hanger 18 example can be functionally tested prior to actual use in a well, and after testing the liner hanger can be conveniently prepared for use. Specifically, the liner hanger 18 can be assembled as described above, but without installing the shear members 92.

Pressure applied to the ports 50 will cause the retainer sleeve 80 to displace downward relative to the mandrel 52, so that the support surface 84 no longer outwardly supports the engagement members 86 in engagement with the recesses 88. When the applied pressure is sufficient to shear the shear members 106, the outer housing 58 will displace upward relative to the mandrel 52 and the engagement members 86 will retract radially inward. The upward displacement of the outer housing 58 will cause the slips 26 to displace upward and radially outward as described above (with the actuation sleeve 60 support surface 62 no longer outwardly supporting the engagement members 64), thereby verifying proper operation of the liner hanger 18.

After the functional testing, the slips 26, engagement members 64 and outer housing 58 can be downwardly displaced to their initial run-in positions. The retainer sleeve 80 can be upwardly displaced to its initial run-in position, with an inclined surface 110 of the openings 94 deflecting the engagement members 86 outward through the openings 98 and back into engagement with the recesses 88. Shear members 92, 106 can then be installed in preparation for use of the liner hanger 18.

It may now be fully appreciated that the above disclosure provides significant advancements to the art of designing, constructing and operating liner hangers for use in subterranean wells. In one example described above, the liner hanger 18 cannot be set, until a sufficient differential pressure has been applied from an interior to an exterior of the liner hanger (e.g., from the port 50 to the annulus 54), thereby preventing inadvertent premature setting of the liner hanger.

The above disclosure provides to the art a liner hanger 18 for use in a subterranean well. In one example, the liner hanger 18 comprises: slips 26 configured to anchor the liner hanger 18 in the well; a tubular mandrel 52; a tubular outer housing 58 outwardly surrounding the mandrel 52; a first engagement member 64 that releasably secures the slips 26 against longitudinal displacement relative to the mandrel 52; and a second engagement member 86 that releasably secures the outer housing 58 against longitudinal displacement relative to the mandrel 52.

The first engagement member 64 may be supported in engagement with a profile 66 formed on the mandrel 52 by a first support surface 62. The first support surface 62 may be configured to permit disengagement of the first engagement member 64 from the profile 66 in response to longitudinal displacement of the outer housing 58 relative to the mandrel 52.

The liner hanger 18 may include a shear member 106 that releasably secures the outer housing 58 against displacement relative to the mandrel 52.

A retainer sleeve 80 may be disposed in an annulus 82 formed between the outer housing 58 and the mandrel 52, the retainer sleeve 80 including a second support surface 84 that supports the second engagement member 86 in engagement with a recess 88 formed in the outer housing 58. The second support surface 84 may be configured to permit disengagement of the second engagement member 86 from the recess 88 in response to longitudinal displacement of the retainer sleeve 80.

The liner hanger 18 may include a first shear member 92 that releasably secures the retainer sleeve 80 against displacement relative to the mandrel 52. The first shear member 92 may be received in a first opening 96 formed in a gauge ring sleeve 90 secured to the mandrel 52, and the second engagement member 86 may be received in a second opening 98 formed in the gauge ring sleeve 90.

A second shear member 106 may be received in the gauge ring sleeve 90. The second shear member 106 may releasably secure the outer housing 58 against displacement relative to the mandrel 52.

The liner hanger 18 may include first and second seals 72, 74 disposed in an annulus 82 formed between the outer housing 58 and the mandrel 52. An annular chamber 76 may be formed longitudinally between the first and second seals 72, 74. Increased fluid pressure applied to the chamber 76 may be operative to displace the outer housing 58 and slips 26 relative to the mandrel 52.

Also provided to the art by the above disclosure is a method of setting a liner hanger 18 in a subterranean well. In one example, the method can comprise: applying a first differential pressure from an interior to an exterior of the liner hanger 18, thereby displacing a retainer sleeve 80 relative to a mandrel 52 of the liner hanger 18; and applying a second differential pressure from the interior to the exterior of the liner hanger 18, thereby displacing an outer housing 58 of the liner hanger 18 relative to the mandrel 52. The outer housing 58 is prevented from displacing relative to the mandrel 52 until after the retainer sleeve 80 is displaced relative to the mandrel 52.

The method may include positioning the retainer sleeve 80 in an annulus 82 formed between the outer housing 58 and the mandrel 52.

The retainer sleeve 80 may displace in a first longitudinal direction relative to the mandrel 52, and the outer housing 58 may displace in a second longitudinal direction relative to the mandrel 52, with the second longitudinal direction being opposite to the first longitudinal direction.

The outer housing 58 displacing step may include permitting disengagement of a first engagement member 64 from a profile 66 formed on the mandrel 52. The retainer sleeve 80 displacing step may include permitting disengagement of a second engagement member 86 from a recess 88 formed in the outer housing 58.

The first differential pressure applying step may include shearing a shear member 92 that releasably secures the retainer sleeve 80 against displacement relative to the mandrel 52. The second differential pressure applying step may include shearing a shear member 106 that releasably secures the outer housing 58 against displacement relative to the mandrel 52.

A system 10 for use with a subterranean well is also described above. In one example, the system 10 can comprise: a running tool 22 comprising a first mandrel 48, a flow passage 34 extending longitudinally through the first mandrel 48, and a first port 46 formed through a sidewall of the first mandrel 48; and a liner hanger 18, the running tool 22 being received in the liner hanger 18, and the liner hanger 18 comprising an outer housing 58, a second mandrel 52, a chamber 76 in fluid communication with the first port 46 via a second port 50 formed through a sidewall of the second mandrel 52, and first and second seals 74, 72 on respective opposite longitudinal sides of the chamber 76. A first differential pressure applied across the first seal 74 is operative to displace a retainer sleeve 80 in a first longitudinal direction relative to the mandrel 52, and a second differential pressure applied across the second seal 72 is operative to displace the outer housing 58 in a second longitudinal direction relative to the mandrel 52. The second longitudinal direction is opposite to the first longitudinal direction.

The second differential pressure may be greater than, less than, or equal to the first differential pressure.

A first shear member 92 may releasably secure the retainer sleeve 80 against displacement relative to the mandrel 52. A second shear member 106 may releasably secure the outer housing 58 against displacement relative to the mandrel 52.

An engagement member 86 radially outwardly supported by the retainer sleeve 80 may prevent displacement of the outer housing 58 relative to the mandrel 52.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A liner hanger for use in a subterranean well, the liner hanger comprising:

slips configured to anchor the liner hanger in the well;

a tubular mandrel;

a tubular outer housing outwardly surrounding the mandrel;

a first engagement member that releasably secures the slips against longitudinal displacement relative to the mandrel;

a second engagement member that releasably secures the outer housing against longitudinal displacement relative to the mandrel; and first and second seals disposed in an annulus formed between the outer housing and the mandrel, in which an annular chamber is formed longitudinally between the first and second seals, and increased fluid pressure applied to the chamber is operative to displace the outer housing and slips relative to the mandrel.

2. The liner hanger of claim 1, in which the first engagement member is supported in engagement with a profile formed on the mandrel by a first support surface, and the first support surface is configured to permit disengagement of the first engagement member from the profile in response to longitudinal displacement of the outer housing relative to the mandrel.

3. The liner hanger of claim 2, further comprising a shear member that releasably secures the outer housing against displacement relative to the mandrel.

4. The liner hanger of claim 2, in which a retainer sleeve is disposed in an annulus formed between the outer housing and the mandrel, the retainer sleeve including a second support surface that supports the second engagement member in engagement with a recess formed in the outer housing, and the second support surface is configured to permit disengagement of the second engagement member from the recess in response to longitudinal displacement of the retainer sleeve.

5. The liner hanger of claim 4, further comprising a first shear member that releasably secures the retainer sleeve against displacement relative to the mandrel.

6. The liner hanger of claim 5, in which the first shear member is received in a first opening formed in a gauge ring sleeve secured to the mandrel, and the second engagement member is received in a second opening formed in the gauge ring sleeve.

7. The liner hanger of claim 6, in which a second shear member is received in the gauge ring sleeve, and the second shear member releasably secures the outer housing against displacement relative to the mandrel.

8. A method of setting a liner hanger in a subterranean well, the method comprising:

applying a first differential pressure from an interior to an exterior of the liner hanger, thereby displacing a retainer sleeve relative to a mandrel of the liner hanger, in which the retainer sleeve displaces in a first longitudinal direction relative to the mandrel; and applying a second differential pressure from the interior to the exterior of the liner hanger, thereby displacing an outer housing of the liner hanger relative to the mandrel, in which the outer housing is prevented from displacing relative to the mandrel until after the retainer sleeve is displaced relative to the mandrel, and in which the outer housing displaces in a second longitudinal direction relative to the mandrel, the second longitudinal direction being opposite to the first longitudinal direction.

9. The method of claim 8, further comprising positioning the retainer sleeve in an annulus formed between the outer housing and the mandrel.

10. The method of claim 8, in which the outer housing displacing comprises permitting disengagement of a first engagement member from a profile formed on the mandrel.

11. The method of claim 10, in which the retainer sleeve displacing comprises permitting disengagement of a second engagement member from a recess formed in the outer housing.

12. The method of claim 8, in which the first differential pressure applying comprises shearing a shear member that releasably secures the retainer sleeve against displacement relative to the mandrel.

13. The method of claim 8, in which the second differential pressure applying comprises shearing a shear member that releasably secures the outer housing against displacement relative to the mandrel.

14. A system for use with a subterranean well, the system comprising:

a running tool comprising a first mandrel, a flow passage extending longitudinally through the first mandrel, and a first port formed through a sidewall of the first mandrel; and a liner hanger, the running tool being received in the liner hanger, and the liner hanger comprising an outer housing, a second mandrel, a chamber in fluid communication with the first port via a second port formed through a sidewall of the second mandrel, and first and second seals on respective opposite longitudinal sides of the chamber, in which a first differential pressure applied across the first seal is operative to displace a retainer sleeve in a first longitudinal direction relative to the second mandrel, and in which a second differential pressure applied across the second seal is operative to displace the outer housing in a second longitudinal direction relative to the second mandrel, the second longitudinal direction being opposite to the first longitudinal direction.

15. The system of claim 14, in which the second differential pressure is greater than the first differential pressure.

16. The system of claim 14, in which a first shear member releasably secures the retainer sleeve against displacement relative to the second mandrel.

17. The system of claim 16, in which a second shear member releasably secures the outer housing against displacement relative to the second mandrel.

18. The system of claim 14, in which an engagement member radially outwardly supported by the retainer sleeve prevents displacement of the outer housing relative to the second mandrel prior to displacement of the retainer sleeve.

* * * * *